US006331120B1

(12) United States Patent
Clement

(10) Patent No.: US 6,331,120 B1
(45) Date of Patent: Dec. 18, 2001

(54) ELECTRICAL CONNECTOR WITH REDUCED CROSSTALK FOR HIGH FREQUENCY SIGNALS

(75) Inventor: Jean Yves Clement, St Jeannet (FR)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/811,928

(22) Filed: Mar. 19, 2001

(30) Foreign Application Priority Data

May 12, 2000 (EP) ..... 00480044

(51) Int. Cl.[7] ..... H01R 4/24
(52) U.S. Cl. ..... 439/418; 439/941
(58) Field of Search ..... 439/418, 404, 439/941, 676

(56) References Cited

U.S. PATENT DOCUMENTS 5,899,770 * 5/1999 Ezawa ..... 439/941
6,080,007 * 6/2000 Dupuis et al. ..... 439/941
6,231,397 * 5/2001 de la Borbolla et al. ..... 439/941

* cited by examiner

*Primary Examiner*—Tho D. Ta
(74) *Attorney, Agent, or Firm*—David R. Irvin

(57) ABSTRACT

An improved electrical connector of the RJ45 ANSI-568 type for terminating a multi-wire cable. The connector has two internal management bars for guiding the cable's wires sequentially through the connector from entry to termination. A first wire of a first wire pair and a second wire of a second wire pair that are adjacent as positioned by the first management bar are not adjacent as positioned by the second management bar. Opposing near-end crosstalk components are introduced into each pair of the cable's wires, thereby reducing near-end crosstalk. In one embodiment, the first management bar positions a set of four wire pairs according to a pattern W1', W1, W2, W3, W3', W2', W4', W4, and the second management bar positions the same set of four wire pairs according to a pattern W1, W1', W2, W3', W3, W2', W4, W4'.

2 Claims, 4 Drawing Sheets

ELECTRICAL CONNECTOR WITH REDUCED CROSSTALK FOR HIGH FREQUENCY SIGNALS

TECHNICAL FIELD

The invention relates generally to electrical connectors and cable assemblies of multi-pair cables terminated by modular plugs, and more particularly to an electrical connector with reduced crosstalk for high frequency signals.

BACKGROUND ART

In data transmission networks there is a problem when data is transmitted at high rates over a plurality of circuits of the type that comprise multi-pair data communication cable. In particular, at high transmission rates, each wiring circuit itself both transmits and receives electromagnetic radiations so that the signals flowing through one circuit or a wire pair may couple with the signals flowing through another wire pair. The unintended electromagnetic coupling of signals between different pairs of conductors of different electrical circuits is called crosstalk and is a source of interference that often adversely affects the processing of these signals. The problem of crosstalk in information networks increases as the frequency of the transmitted signals increases.

A high speed data transmission cable is typically terminated by a modular plug which conventionally comprises an insulating housing in which a planar array of closely spaced parallel passages receive the ends of respective cable wires. The cable typically comprises four circuits defined by eight wires arranged in four twisted pairs. Typically, the cable is terminated by a modular plug having eight contacts engaging the ends of the eight wires, which are received in respective wire-receiving passages arranged in a row. Specified ones of the four pairs of the plug contacts are assigned to terminate respective specified ones of the four cable wire pairs according to ANSI/EIA/TIA standard 568. For example, the standard 568B contact assignment for the wire pair designated #1 is the pair of plug contacts located at the 4–5 contact positions. The cable wires of the pair designated #3 are, according to standard 568, terminated by the plug contacts located at the 3–6 positions, which saddle the 4–5 plug contacts that terminate wire pair #1. Near-end crosstalk between wire pairs #1 and #3 during high speed data transmission has been found to be particularly troublesome in modular plugs that terminate cable according to standard 568B.

The above problem is partially solved in U.S. Pat. No. 5,628,647 which describes an electrical connector wherein the modular plug includes an insulating or dielectric housing having a plurality of wire-receiving passages disposed in first and second substantially parallel planar arrays spaced one above the other, the passages of the first planar array being staggered in position with respect to the passages of the second planar array. The end of a first wire of each of the first and second wires or signal pairs is received in a respective wire-receiving passage in the first planar array while the end of a second wire of each of the first and second signal pairs is received in a respective wire-receiving passage in the second planar array. The wire-receiving passages in which the wire ends of the first and second wire pairs are received are selected such that the pins of the first signal pair are situated in a first pair plane and the pairs are received are selected such that the pins of the first signal pair are situated in a first pair plane and the pins of the second signal pair are situated in a second pair plane that intersects the first pair plane so that the signal loops generated by the signal pairs are oriented at an angle to each other.

However, there are now new classes defining high speed data transmission. For Example, performances to be met for class E correspond to the range of signals having a frequency up to 200 MHz and even 250 MHz. Thus there remains a need to further improve the connector performances, and in particular to reduce further the Near end crosstalk (NEXT) between the different pairs of the connector, rather than just between pair #1 and pair #3 as addressed by standard 568B.

SUMMARY OF THE INVENTION

Accordingly, an object of present the invention is to provide an electrical connector for a saddle twisted pair such as a RJ45 plug including a plurality of wire pairs, which reduces the crosstalk between two pairs to a level that falls below a predetermined threshold.

The invention relates therefore to an electrical connector, including a multi-wire cable terminated by a modular plug, wherein the multi-wire cable is composed of a plurality of pairs of wire. The modular plug includes a dielectric housing that has a plurality of wire-receiving passages disposed in a first and a second substantially parallel planar arrays for receiving each one of the wires comprising the multi-wire cable. The passages of the first planar array are staggered in position with respect to the passages of the second planar of these terminals electrically engages a respective one of the wire ends received in a communicating wire-receiving passage. The dielectric housing comprises a first and a second staggered wires devices or management bars. The second staggered wires device is structurally identical to the first staggered wires device, but having rotated of $\pi$ the plane corresponding to the plane of each array. Each wire received in a wire-receiving passage of the first staggered wires device is shifted on the left, the right, upward or downward when received in a wire receiving passage of the second staggered wires device in order to reduce the crosstalk between any two pairs of wires under a predetermined threshold.

BRIEF DESCRIPTION OF THE DRAWINGS

The invention and the advantages thereof will be readily understood in reference to the following detailed description considered in connection with the accompanying drawings in which.

DETAILED DESCRIPTION OF THE INVENTION

Figure 1:
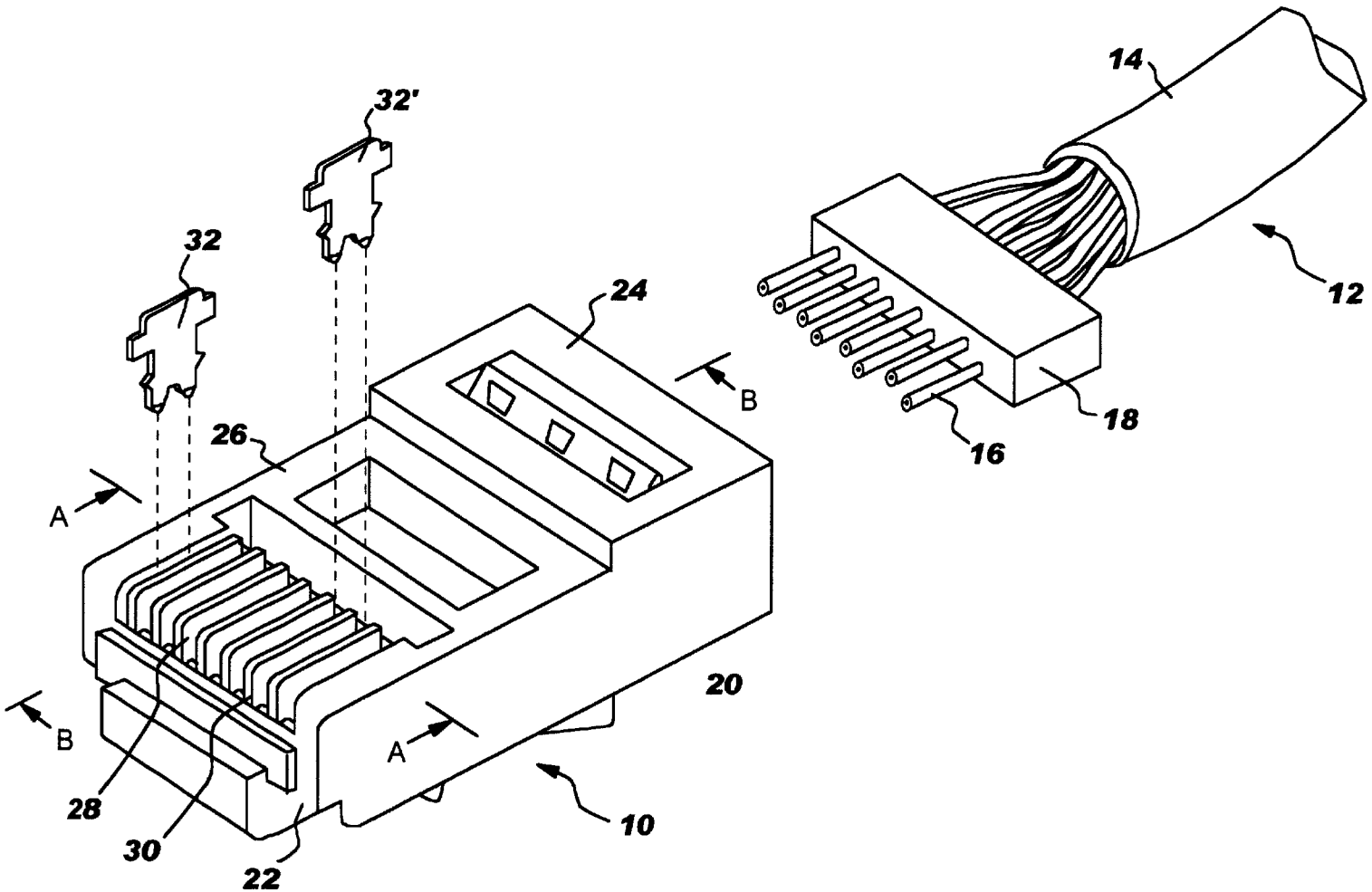
FIG. 1 (Prior Art)
FIG. 1 is a perspective view of an electrical connector and its corresponding multi-pair cable according to the prior art.
Figure 2:
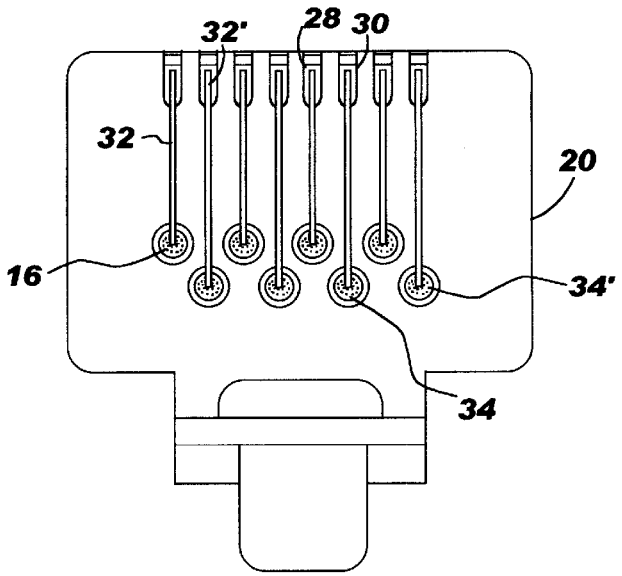
FIG. 2 (Prior Art)
FIG. 2 is a transverse cross-section view along line A—A of the connector illustrated in FIG. 1.

FIG. 1 shows an electrical connector 10 such as a RJ45 plug for terminating a multi-pair communication cable 12, which uses the improvements described in patent U.S. Pat. No. 5,628,647. Cable 12 comprises an insulating sheath 14 enclosing four pairs of wires 16. A management bar 18 is used to help align the wire ends when the connector is first attached to the cable.

The construction of the plug 10 which is well known, generally comprises a dielectric housing 20 having a closed forward free end 22, a cable-receiving rearward end 24, a terminal receiving side 26, and a cable-receiving cavity (36 of FIG. 3) extending longitudinally forward from the rearward end 24. Eight parallel slots 28 defined by corresponding fins 30 open on the terminal-receiving side 26 for receiving flat contact terminals 32 or 32'. corresponding to the second planar array, is inserted into and fixed within an associated slot 28, thus terminating a respective wire 16 located in a respective wire-receiving passage 34 or 34'.

Figure 3:
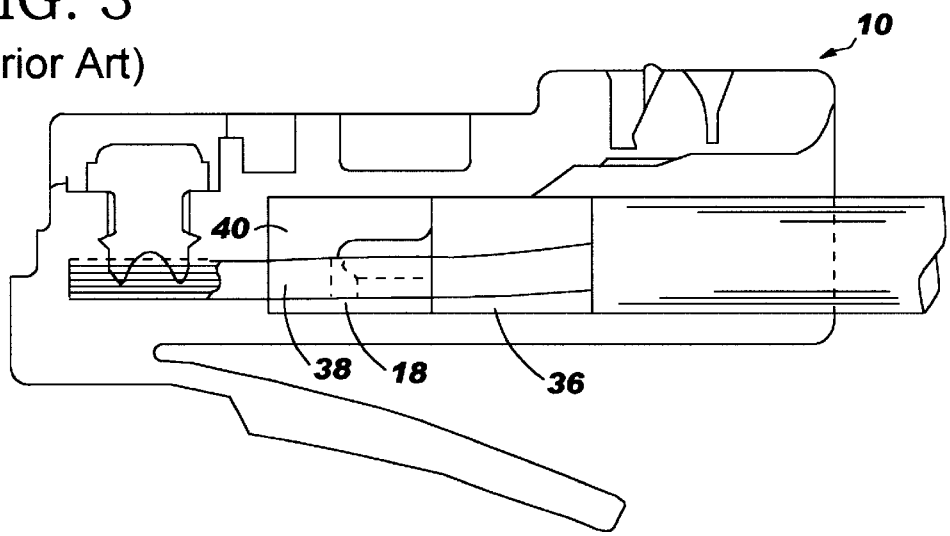
FIG. 3 (Prior Art)
FIG. 3 is a longitudinal section view along line B—B of the connector illustrated in FIG. 1.

Absent the present invention, a single management bar 18 is used as already mentioned with reference to FIG. 1. As shown in FIG. 3, which provides a longitudinal section view of electrical connector 10, and FIG. 1, such a management bar 18 comprises a block-shaped plastic member having an outer configuration which corresponds to the shape of the forward end of the cable-receiving cavity 36. A pair of planar arrays of four bores 38 each is formed through bar 18. The bores 38 have the same spacing as the dual array arrangement of the wire-receiving passages 34 or 341. The diameter of each of the bores 38 is slightly larger than the diameter of the wires 16 to allow for a sliding fit of the wires 16.

During assembly, the wires 16 of the four signal pairs are initially inserted into the particular bores 38 of the management bar 18 that correspond in location to the positions of the passages 34 or 34, as designated by the standard terminal arrangement. The wires 16 are sheared flush with the forward face 40 of the management bar 18 whereupon the management bar 18 bar is inserted into the cable-receiving cavity 36. The management bar 18 is urged forwardly through the cavity 36 until its forward face 40 abuts the front end of cavity 36. The cable wires 16 are then urged forwardly through the bores 38 to pass into the aligned wire-receiving passages 34 or 34'. It will be understood by those skilled in the art that the management bar 18 may have other configurations that provide the same function.

The present invention, which will now be described, reduces or eliminates the Near end crosstalk (NEXT) between each two pairs of the cable 14, by crossing the wires 16 as shown schematically in FIG. 4. The principle underlying the invention is the addition of an opposite crosstalk signal −Nx on each wire 16 that is perturbed by a crosstalk Nx. Thus, when the present invention is applied to an RJ45, wires 16 comprising the four pairs, which are designated ($W_1$, $W_1'$), ($W_2$, $W_2'$), ($W_3$, $W_3'$) and ($W_4$, $W_4'$), are placed in the following order when connected to the flat contact terminals 32 and 32A:

$W_1'$ $W_1$ $W_2$ $W_3$ $W_3'$ $W_2'$ $W_4'$ $W_4$

Figure 4:
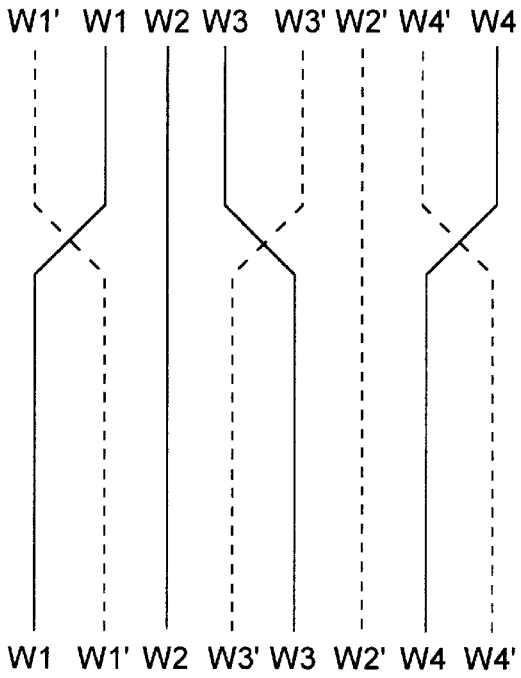
FIG. 4 is a schematic representation of the wires being crossed between the first management bar and the second management bar of the electrical connector according to the invention.

It is assumed that the crosstalk $N_1$ is induced by wire $W_1$ into wire $W_2$ immediately adjacent to $W_1$ at the top of FIG. 4. Since the signals flowing in the two wires of a pair are opposite, a crosstalk $-N_1$ will be induced into the wire $W_2$ by the wire $W_1'$ at the bottom of FIG. 4, if the two wires $W_1$ and $W_1'$ are crossed as illustrated in FIG. 4. The net result is that crosstalk $N_1$ is compensated by crosstalk $-N_1$ in wire $W_2$.

In the same way, a crosstalk $N_3$ is induced by wire $W_3$ into wire $W_2$ immediately adjacent to wire $W_3$ at the top of FIG. 4. By crossing the two wires $W_3$ and $W_3'$ as illustrated in FIG. 4, a crosstalk $-N_3$ is induced by wire $W_3'$ into wire $W_2$ at the bottom of FIG. 4. The net result is that the crosstalk $N_3$ is compensated by crosstalk $-N_3$ in wire $W_2$.

Reciprocally the wire $W_2$ induces a crosstalk $+N_2$ first into wire $W_1$ and then into wire $W_1'$. Because a receiver responds to the differential signal between the two wires $W_1$ and $W_1'$ of the pair the crosstalk $N_2$ is effectively removed from the resulting differential signal as a common mode signal. It is the same thing for the crosstalk induced by wire $W_2$ into the wires $W_3$ and $W_3'$. Likewise, the crosstalk $-N_2$ induced by wire $W_2'$ into each wire of the pair $W_3$ and $W_3'$ and into each wire of the pair $W_4$ and $W_4'$ is removed by the differential receiver of each pair. explanation similar to that given for wire $W_2$ holds for wire $_2'$. By crossing wires $W_3$ and $W_3'$, a crosstalk $-N_3$ induced by $W_3'$ into wire $W_2$, is compensated by a crosstalk $N_3$ induced by wire $W_3$ into $W_2'$. In the same way, a crosstalk $-N_4$ induced by wire $W_4'$ into wire $W_2'$. But this crosstalk is compensated by a crosstalk $N_4$ induced by wire $W_4$ into wire $W_4'$. Because of the crossing of the wires in the connector.

Figure 5A:
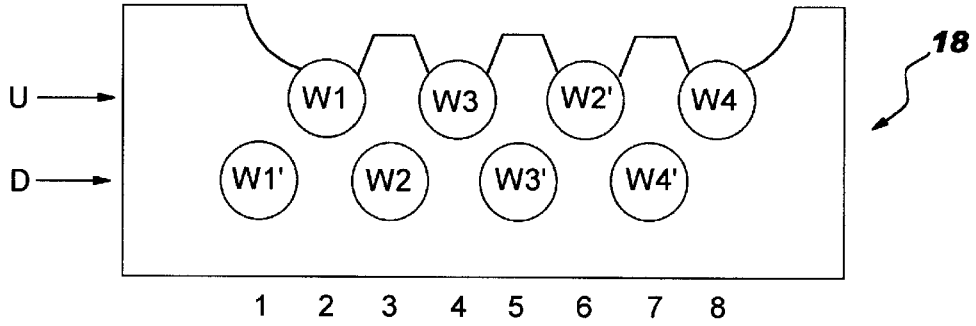
FIG. 5A and 5B are schematic representations of the management bars and the wire-receiving passages therein showing the wires which are located in those passages in the first and the second management bars.

In order to cross the wire 16 as just described, and consequently to reduce of eliminate crosstalk, the present invention includes a second management bar 18. As illustrated in FIG. 5A, the wires 16 are disposed according to two planar arrays, staggered in position, in the first management bar 18, and ordered horizontally according to the following sequence $W_1'$ $W_1$ $W_2$ $W_3$ $W_3$ $W_2'$ $W_4'$ $W_4$, which corresponds schematically to the order shown at the top of FIG. 4.

Figure 5B:
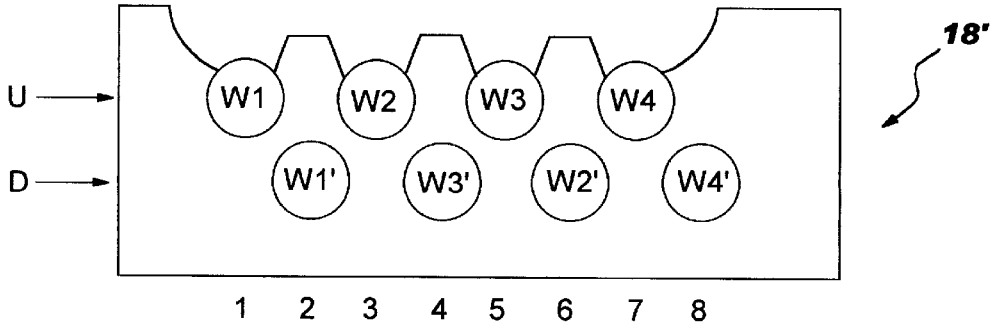

The second management bar 18' is a device which is similar in bore pattern to the first management bar 18 (also called a staggered wires device), but which is obtained by a o rotation of the latter in the plane corresponding to the planes containing the arrays. Thus, the second management bar 18' is a mirror staggered wires device with respect to the first management bar 18. To obtain the crossing of the wires as shown in FIG. 4, it is only necessary to dispose the wires as illustrated in FIG. 5B. The wires are ordered horizontally in the second management bar 18' according to the following sequence:

$W_1$ $W_1'$ $W_2$ $W_3'$ $W_3$ $W_2'$ $W_4$ $W_4'$,

Which corresponds schematically to the order shown at the bottom of FIG. 4.

Thus, from the first management bar 18 to the second management bar 18', the modifications are the following $W_1$ is shifted to the left $W_1'$ is shifted to the right $W_2$ is shifted downward $W_3$ is shifted to the right $W_3'$ is shifted to the left $W_2'$ is shifted upward $W_4$ is shifted to the left $W_4'$ is shifted to the right If the passages of the management bar 18 or 18' for receiving the wires are defined by Ui or Dj where U is the Up array, D the Down array and i or j designates the horizontal position of the passages from 1 to 8, the following corresponding table between the wire and its location for each management bar can be established:

| | First management bar | Second management bar |
|---|---|---|
| $W_1$ | $U_2$ | $U_1$ |
| $W_1'$ | $D_1$ | $D_2$ |
| $W_2$ | $D_3$ | $U_3$ |
| $W_2'$ | $U_6$ | $D_6$ |
| $W_3$ | $U_4$ | $U_5$ |
| $W_3'$ | $D_5$ | $D_4$ |
| $W_4$ | $U_8$ | $U_7$ |
| $W_4'$ | $D_7$ | $D_8$ |

It can be easily verified that in all pairs of wires wherein the two wires are immediately adjacent at the top of FIG. 4, one wire is shifted to the left and the other is shifted to the right. But in the pair ($W_2$ $W_2'$) wherein the two wires are separated at the top of FIG. 4, one wire is shifted downward whereas the other is shifted upward. It must be noted that the two wires of an adjacent pair must be crossed as mentioned above in reference to FIG. 4 thereby resulting in the shifting to the left or to the right of each wire, whereas the two wires of any pair wherein the wires are not adjacent are not crossed thereby resulting in the shifting upward or downward of each wire.

Figure 6:
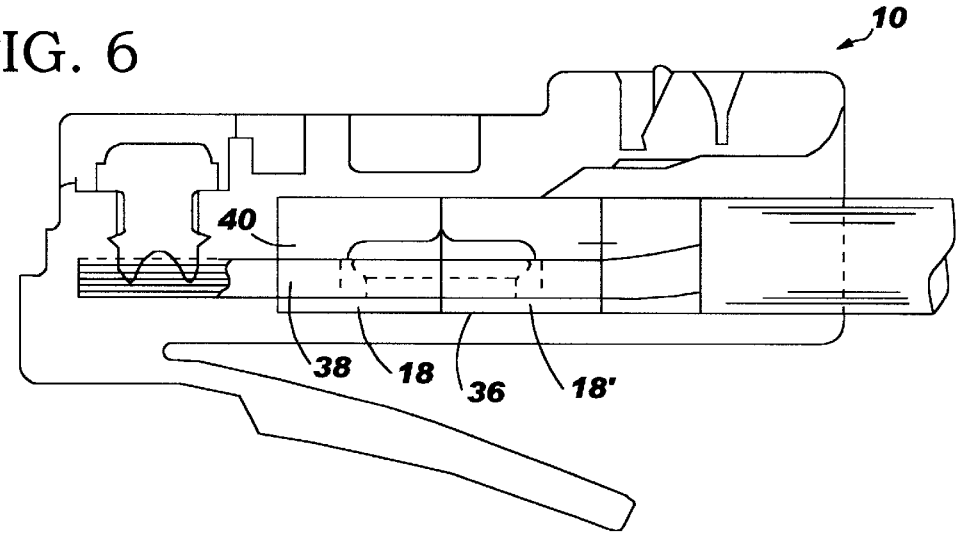
FIG. 6 is a longitudinal section view of the electrical connector similar to the view of FIG. 3 but including a second management bar according to the invention.
Figure 7:
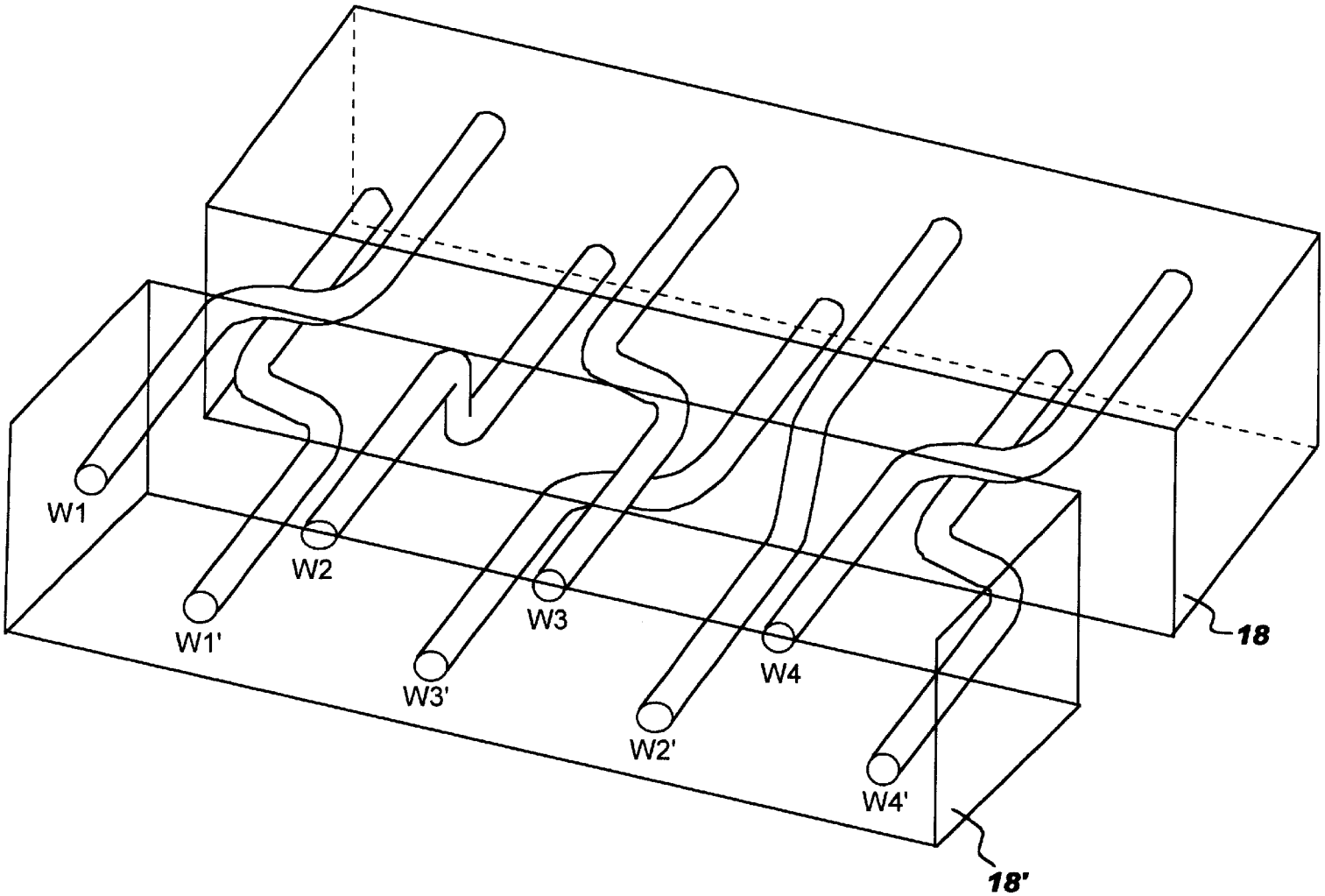
FIG. 7 is a tridimensional schematic representation of the wires being shifted from the first management bar to the second management bar of the electrical connector according to the invention.

The implementation of the invention using a first management bar 18 and a second management bar 18' where the second management bar 18' is obtained by a $\pi$ rotation of the first management bar 18 (mirror device) is represented in FIG. 6 and results in the relative positioning of the wires as illustrated in FIG. 7.

It must be noted that the implementation of the invention as described above enables the crosstalk between any pair of wires to be reduced under a threshold corresponding to a signal-to-noise ratio (SNR) greater than 40 dB, whereas the SNR varies between 28 and 38 dB without the use of the invention.

Although the implementation shown in FIG. 6 is the preferred embodiment of the invention, it is clear that adaptations can be brought while being within the scope of the invention. Thus, the length of the second management bar 18' might be different from the length of the first management bar 18. Such a difference could compensate the fact that a crosstalk is also induced by the flat contact terminals of the connector, resulting for example in a crosstalk in wire $W_2$ which is not $N_1$ but $N_1'>N_1$. To compensate such a perturbation signal, it is then necessary to have a mirror management bar 18' the length of which is greater than the length of the management bar 18 so that the crosstalk induced in $W_2$ is $-N_1'$. Another solution could be to put in the connector a plurality of identical management bars such as management bar 18' and which could have a length less important, in order to compensate the crosstalk due to the first management bar as well as the flat contact terminals.

I claim:

1. An electrical connector for terminating a multi-wire cable that includes a plurality of wire pairs, the connector comprising:

a dielectric housing for accepting entry of the multi-wire cable and enclosing at least two management bars;

a first management bar within the housing, the first management bar having a first set of bores for receiving and positioning wire pairs of the multi-wire cable entering the housing; and a second management bar within the housing, the second management bar having a second set of bores for receiving and positioning wire pairs that exit the first management bar;

wherein the first management bar positions a set of four wire pairs according to a pattern W1', W1, W2, W3, W3', W2', W4', W4, and the second management bar positions the same set of four wire pairs according to a pattern W1, W1', W2, W3', W3, W2', W4, W4'.

2. An electrical connector for terminating a multi-wire cable that includes a plurality of wire pairs, the connector comprising:

a dielectric housing for accepting entry of the multi-wire cable and enclosing at least two management bars;

a first management bar within the housing, the first management bar having a first set of bores for receiving and positioning wire pairs of the multi-wire cable entering the housing; and a second management bar within the housing, the second management bar having a second set of bores for receiving and positioning wire pairs that exit the first management bar;

wherein the second management bar positions a set of four wire pairs according to a pattern W1', W1, W2, W3, W3', W2', W4', W4, and the first management bar positions the same set of four wire pairs according to a pattern W1, W1', W2, W3', W3, W2', W4, W4'.

* * * * *

UNITED STATES PATENT AND TRADEMARK OFFICE

CERTIFICATE OF CORRECTION

PATENT NO. : 6,331,120 B1
DATED : December 18, 2001
INVENTOR(S) : Jean Yves Clement It is certified that error appears in the above-identified patent and that said Letters Patent is hereby corrected as shown below:

Column 4,
Line 38, change "o rotation" to -- "pi rotation" --

Signed and Sealed this

Seventh Day of May, 2002

*Attest:*

*Attesting Officer*

JAMES E. ROGAN
*Director of the United States Patent and Trademark Office*